US010292477B2

(12) United States Patent
Hori

(10) Patent No.: US 10,292,477 B2
(45) Date of Patent: May 21, 2019

(54) DRAWING APPARATUS AND CONTROL METHOD OF DRAWING APPARATUS

(71) Applicant: CASIO COMPUTER CO., LTD., Tokyo (JP)

(72) Inventor: Masahiro Hori, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 441 days.

(21) Appl. No.: 15/148,871

(22) Filed: May 6, 2016

(65) Prior Publication Data

US 2016/0367010 A1 Dec. 22, 2016

(30) Foreign Application Priority Data

Jun. 18, 2015 (JP) ..... 2015-122556

(51) Int. Cl.
*A45D 29/00* (2006.01)
*A45D 29/22* (2006.01)

(52) U.S. Cl.
CPC ..... *A45D 29/22* (2013.01); *A45D 29/00* (2013.01); *A45D 2029/005* (2013.01)

(58) Field of Classification Search
CPC .. A45D 29/22; A45D 29/00; A45D 2029/005; A45D 29/004; A45D 29/007; A45D 29/11; A45D 29/12; A45D 29/14; A45D 29/18; B41J 3/4073; B41J 3/407; B41J 11/02; B41J 2/14; A61G 13/124
USPC ..... D28/61, 56; 248/118, 118.1, 118.3, 248/118.5
See application file for complete search history.

(56) References Cited

U.S. PATENT DOCUMENTS 6,336,694 B1 * 1/2002 Ishizaka ..... A45D 29/00 347/105
8,231,292 B2 * 7/2012 Rabe ..... A45D 34/041 401/19
8,721,068 B2 * 5/2014 Yamasaki ..... A45D 29/00 347/104
8,757,171 B2 * 6/2014 Goff ..... A45D 29/22 101/35
9,090,092 B2 * 7/2015 Bitoh ..... A45D 29/00
9,156,282 B2 * 10/2015 Yamasaki ..... B41J 3/4073
9,781,989 B2 * 10/2017 Yamasaki ..... B41J 3/407
9,808,068 B2 * 11/2017 Yamasaki ..... A45D 29/00
9,894,976 B2 * 2/2018 Shimizu ..... G06K 15/021
9,943,154 B2 * 4/2018 Teshima ..... B41J 3/407
(Continued)

FOREIGN PATENT DOCUMENTS

JP 2000-194838 A 7/2000
JP 2000-325136 A 11/2000
JP 2012-135600 A 7/2012

*Primary Examiner* — Nicholas D Lucchesi
(74) *Attorney, Agent, or Firm* — Fitch, Even, Tabin & Flannery LLP

(57) ABSTRACT

A drawing apparatus that enables visual check when placing a nail on a movable section and accurately positions the nail in a drawing area in the apparatus is provided. The drawing apparatus includes: a finger insertion section in which a finger is inserted from an insertion opening; and a movable section that is provided in the insertion section, is biased toward a first position near the insertion opening, and moves the finger from the first position to a second position by pushing, against the bias, the finger inserted in the insertion opening.

11 Claims, 4 Drawing Sheets

(56) References Cited

U.S. PATENT DOCUMENTS

| | | | | |
|---|---|---|---|---|
| 2009/0153604 | A1* | 6/2009 | Chen | B41J 3/28 347/9 |
| 2011/0108047 | A1* | 5/2011 | Goff | A45D 29/00 132/73.5 |
| 2012/0147113 | A1* | 6/2012 | Yamasaki | A45D 29/00 347/104 |
| 2016/0088197 | A1* | 3/2016 | Yamasaki | H04N 5/225 132/73.6 |
| 2016/0174680 | A1* | 6/2016 | Yamasaki | B41J 3/407 132/200 |
| 2016/0367011 | A1* | 12/2016 | Hori | A45D 29/00 |
| 2016/0374450 | A1* | 12/2016 | Bitoh | A45D 29/22 132/200 |
| 2016/0374452 | A1* | 12/2016 | Yamasaki | B41J 3/407 132/200 |
| 2017/0008305 | A1* | 1/2017 | Kobayashi | B41J 3/4073 |
| 2017/0015125 | A1* | 1/2017 | Kobayashi | B41J 29/393 |
| 2017/0181521 | A1* | 6/2017 | Yamasaki | A45D 29/00 |
| 2017/0181522 | A1* | 6/2017 | Yoshigai | A45D 29/22 |
| 2017/0273433 | A1* | 9/2017 | Hori | B41J 3/407 |
| 2018/0008025 | A1* | 1/2018 | Yamasaki | A45D 29/00 |
| 2018/0084889 | A1* | 3/2018 | Hori | A45D 29/22 |

* cited by examiner

DRAWING APPARATUS AND CONTROL METHOD OF DRAWING APPARATUS

CROSS-REFERENCE TO RELATED APPLICATIONS

This application is based upon and claims the benefit of priority from the prior Japanese Patent Application No. 2015-122556, filed Jun. 18, 2015, the entire contents of which are incorporated herein by reference.

BACKGROUND OF THE INVENTION

1. Field of the Invention

The present invention relates to a drawing apparatus and a control method of a drawing apparatus.

2. Description of the Related Art

Various techniques have been conventionally proposed for drawing apparatuses that draw nail designs on fingernails.

Japanese Patent Application Laid-Open No. 2000-194838 discloses a nail art apparatus including a finger insertion opening and a stopper provided at the back of the finger insertion opening. In this nail art apparatus, a user inserts his or her finger, the nail of which is subjected to design drawing, into the finger insertion opening, and brings the tip of the finger or nail into contact with the stopper, thus positioning the nail in the apparatus.

However, the nail art apparatus in Japanese Patent Application Laid-Open No. 2000-194838 has a problem in that nail positioning is difficult as the user needs to bring the tip of the finger or nail into contact with the stopper in a state where he or she cannot see the fingertip or nail at the back of the finger insertion opening.

The present invention has been developed in view of such circumstances, and has an object of providing a drawing apparatus that enables visual check when placing a nail on the upper surface of a movable section and accurately positions the nail in a drawing area in the apparatus.

SUMMARY OF THE INVENTION

To solve the stated problem, a drawing apparatus according to the present invention includes: a drawing section that performs drawing on at least one nail of a finger or toe; an insertion section in which the finger or toe is inserted from an insertion opening; and a movable section that is provided in the insertion section, is biased toward a first position near the insertion opening, and moves the finger or toe from the first position to a second position by pushing, against the bias, the finger or toe inserted in the insertion opening.

According to the present invention, it is possible to provide a drawing apparatus that enables visual check when placing a nail on the upper surface of a movable section and accurately positions the nail in a drawing area in the apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
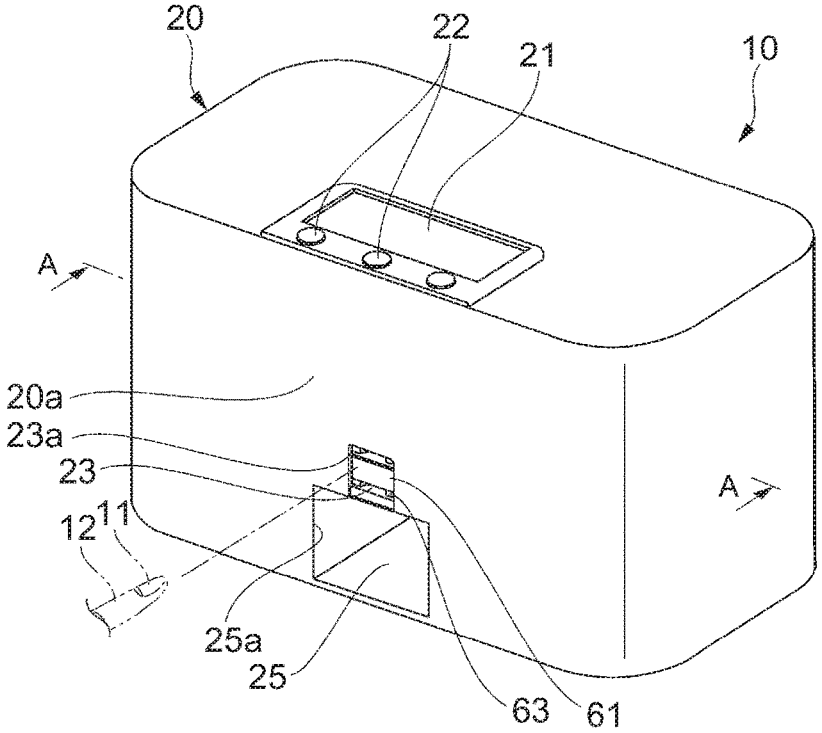
FIG. 1 is a perspective view illustrating the appearance of a drawing apparatus according to an embodiment of the present invention.

A mode for carrying out the present invention (hereinafter referred to as an "embodiment") is described in detail below, with reference to the accompanying drawings. Throughout the description of the embodiment, the same elements are given the same reference signs.

Although the following embodiment assumes that the drawing apparatus performs drawing on the surface of a fingernail, the surface subjected to drawing according to the present invention is not limited to the surface of a fingernail, but may be the surface of a toenail as an example.

As illustrated in FIG. 1, a drawing apparatus 10 has a drawing function, and draws a nail design on a nail 11 of a human finger 12. The drawing apparatus 10 includes a box-shaped housing 20. A display section 21 and an operation section 22 are provided on the upper surface (top board) of the housing 20. An insertion opening 23*a* of a first finger insertion section 23 is formed at the lower center of a front part 20*a* of the housing 20, and also an insertion opening 25*a* of a second finger insertion section 25 is formed below the first finger insertion section 23. The second finger insertion section 25 is a space that is formed from the front part 20*a* of the housing 20 toward the back and into which other fingers of the same hand as the finger 12 subjected to drawing are inserted. The second finger insertion section 25 is a space separated from (not communicating with) the internal space of the housing 20.

Figure 2:
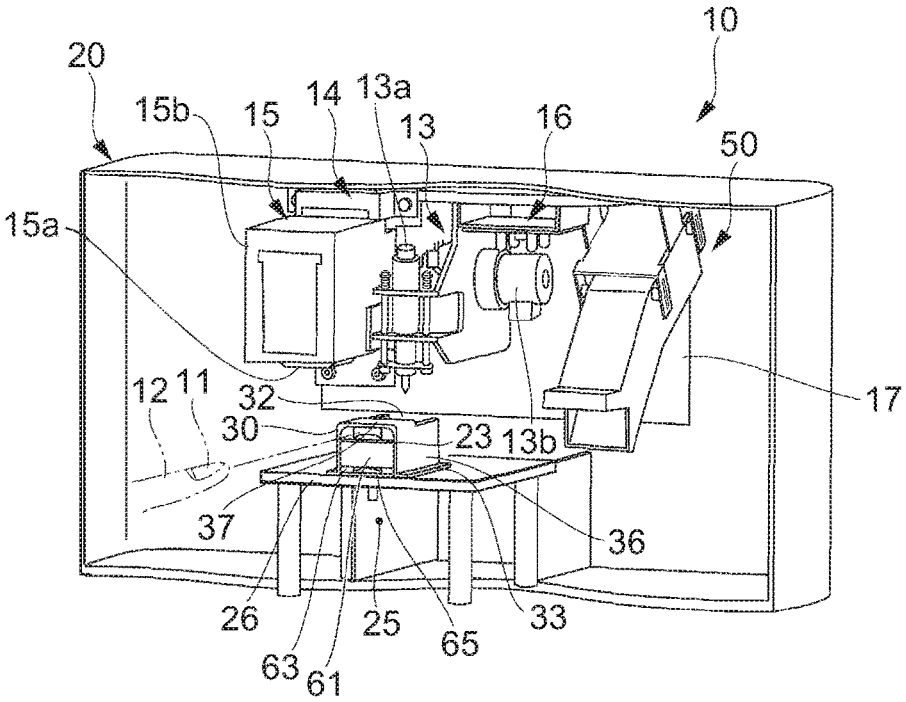
FIG. 2 is a sectional view of a housing along line A-A in FIG. 1.

As illustrated in FIG. 2, a finger placement table 26 is provided at the bottom in the housing 20, and a finger holding case 30 is set on the upper surface of the finger placement table 26. The internal space of the finger holding case 30 is a space for forming the first finger insertion section 23.

A fixing plate 17 is installed in the housing 20 so as to be movable in the apparatus width direction and the apparatus depth direction. A drawing section 14 including a pen plotter section 13 and an inkjet section 15 is fixed to one of the right and left of the fixing plate 17 (the left in this example), and a drier 50 for drying the ink applied to the nail 11 by hot air is fixed to the other one of the right and left of the fixing plate 17 (the right in this example). An image acquisition section 16 for recognizing the position and shape of the nail 11 is placed between the drawing section 14 and the drier 50. FIG. 2 illustrates the inside of the apparatus when the pen plotter section 13 has been moved to the position directly above an opening 32 (described later) of the finger holding case 30.

The pen plotter section 13 includes a pen 13*a* for performing drawing on the nail 11, and is movable integrally with the fixing plate 17 in the apparatus width direction and the apparatus depth direction and also movable up and down by driving means 13*b* such as a stepping motor. The pen plotter section 13, after moving to the position directly above the opening 32 of the finger holding case 30, applies a base coat or the like on the surface of the nail 11 with the pen tip of the pen 13*a* lowered to touch the surface of the nail 11.

The inkjet section 15 includes an inkjet head 15*a* and an inkjet cartridge 15*b*, and prints a nail design onto the nail 11 by the inkjet head 15*a*. The inkjet section 15 is movable integrally with the fixing plate 17 in the apparatus width direction and the apparatus depth direction, and moves to the position directly above the opening 32 of the finger holding case 30 and draws a desired design on the surface of the nail 11 with the inkjet head 15*a*.

Figure 3:
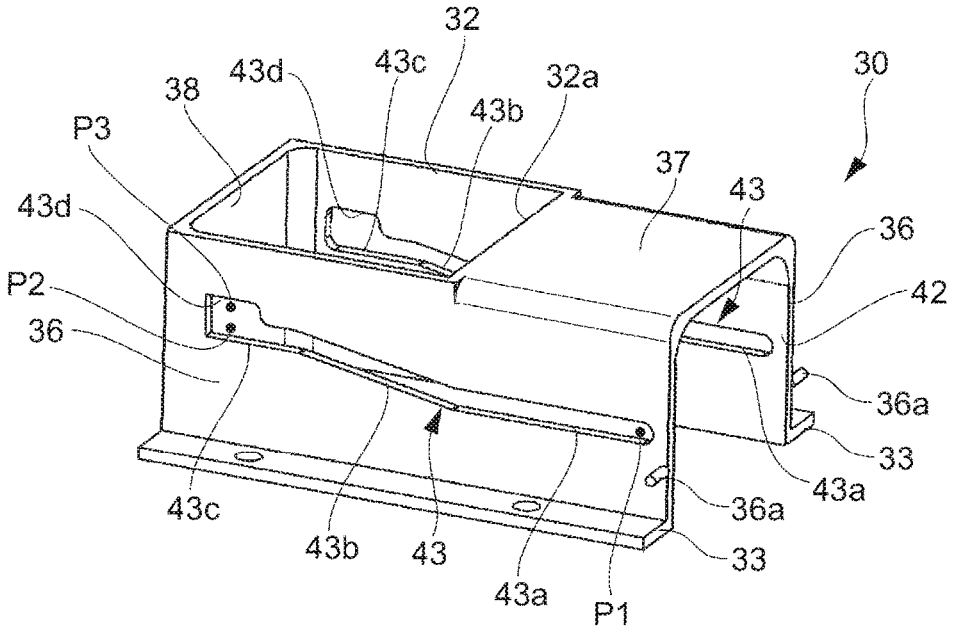
FIG. 3 is a perspective view of a finger holding case according to the embodiment.

As illustrated in FIG. 3, the finger holding case 30 has a pair of right and left attachment sections 33 attached to the finger placement table 26 (see FIG. 2). The finger holding case 30 also has: a pair of right and left side walls 36 formed upward respectively from the right and left attachment sections 33; an upper wall 37 connecting the upper edges of the right and left side walls 36 in the part closer to the front side in the finger insertion direction (hereafter simply referred to as the "front side"); and a back wall 38 connecting the edges of the right and left side walls 36 on the back side in the finger insertion direction (hereafter simply referred to as the "back side"). The upper part of the finger holding case 30 closer to the back side has the opening 32 through which the nail 11 of the inserted finger 12 is exposed upward.

A case-side hook 36*a* for hooking one end of an extension coil spring 62 (described later) projects laterally from the front end of each side wall 36. Each side wall 36 is also provided with a finger insertion direction guide section 43 extending from near the front end (a first position (designated as P1 in FIG. 3)) to near the back end (a third position (designated as P3 in FIG. 3)).

Each finger insertion direction guide section 43 is a section for guiding a movable section (a movable table) 61 (described later) in the finger insertion direction, and is a groove formed through the thickness of the side wall 36. The finger insertion direction guide section 43 includes a first guide section 43*a*, a second guide section 43*b*, and a third guide section 43*c*. The first guide section 43*a* extends horizontally (in parallel with the upper wall 37) from the front end of the side wall 36 to a front end 32*a* of the opening 32 or its vicinity, in the finger insertion direction. The second guide section 43*b* extends obliquely upward (so as to gradually approach the opening 32) from the back end of the first guide section 43*a* toward further back, with a predetermined inclination angle. The third guide section 43*c* is formed horizontally (in parallel with the upper wall 37) from the back end of the second guide section 43*b* toward further back, up to near the back wall 38. The third guide section 43*c* is depressed upward to form a lock section 43*d*.

Figure 4:
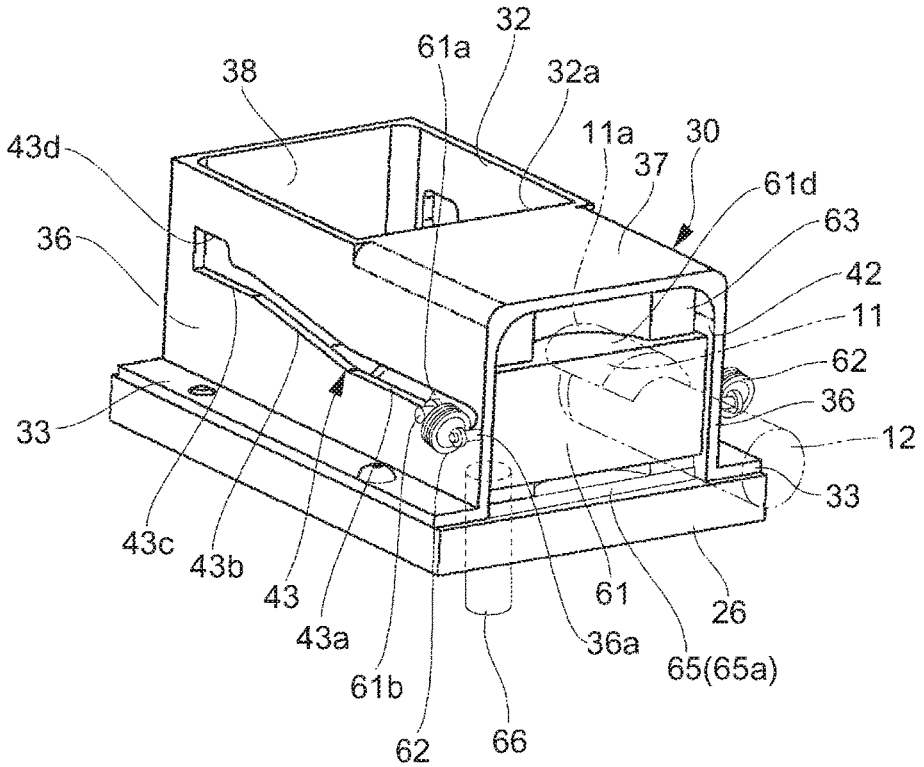
FIG. 4 is a perspective view of the finger holding case and its internal structure according to the embodiment.

As illustrated in FIG. 4, the finger holding case 30 has: the movable table 61 placed in the first finger insertion section 23 and movable along the finger insertion direction; the extension coil spring 62 for biasing the movable table 61; a vertical guide member 63 movable along the finger insertion direction together with the movable table 61; and an expansion and contraction member 65 located on the lower side of the first finger insertion section 23.

Figure 5A:
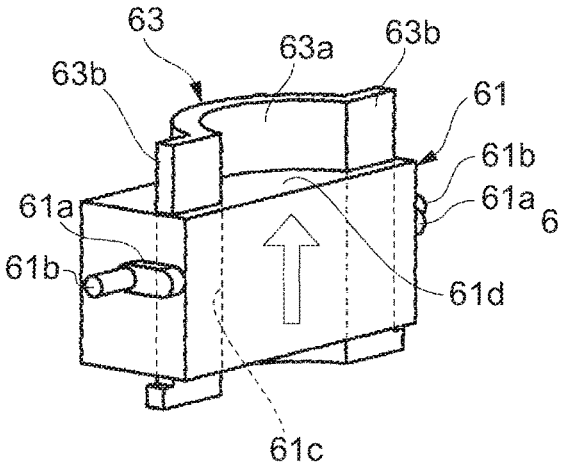
FIG. 5(*a*) is a perspective view of a movable table and a vertical guide member in a state where the movable table has been moved downward, and (b) is a perspective view of the movable table and the vertical guide member in a state where the movable table has been moved upward.
Figure 5B:
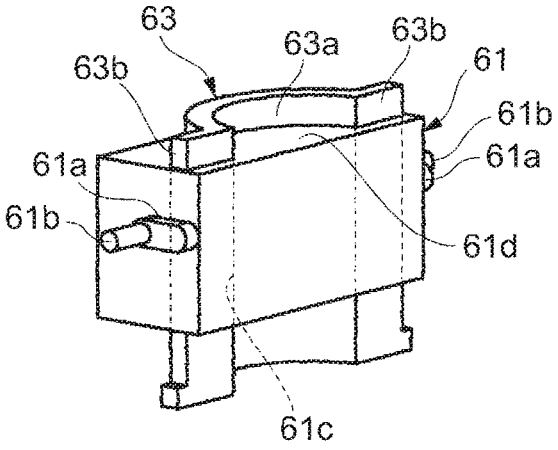

As illustrated in FIGS. 5(*a*) and (*b*), the vertical guide member 63 is a member for guiding the vertical movement of the movable table 61 that moves along the finger insertion direction, and includes: an arc-shaped plate section 63*a* shaped like an arc in cross section; and right and left side plate sections 63*b* laterally extending from both sides of the arc-shaped plate section 63*a*.

The movable table 61 is a member shaped like a rectangular parallelepiped. A projection 61*a* that is fitted into the finger insertion direction guide section 43 (see FIG. 4) from inside is formed on each of the right and left sides of the movable table 61. Each projection 61*a* has a shape that is long in the extension direction of the finger insertion direction guide section 43 (see FIG. 4). This prevents the projection 61*a* from rotating in the finger insertion direction guide section 43 (see FIG. 4). A table-side hook 61*b* for hooking the other end of the extension coil spring 62 projects laterally from the side of each projection 61*a*.

The movable table 61 also has a slide hole 61*c* that vertically passes through the movable table 61. The slide hole 61*c* has an internal shape corresponding to the cross-sectional shape of the vertical guide member 63. A substantially semicircular nail placement surface 61*d* on which the distal edge 11*a* of the nail 11 is placed is formed on the upper surface of the movable table 61 on the front side of the arc-shaped plate section 63*a* of the vertical guide member 63.

The vertical movement of the movable table 61 is guided by the vertical guide member 63 in a manner that the slide hole 61*c* of the movable table 61 slides along the vertical guide member 63 between the lowest position with respect to the vertical guide member 63 (see FIG. 5(*a*)) and the highest position with respect to the vertical guide member 63 (see FIG. 5(*b*)).

Referring back to FIG. 4, the movable table 61 whose vertical movement is guided by the vertical guide member 63 is guided in its movement in the finger insertion direction by the finger insertion direction guide section 43 (the first guide section 43*a*, the second guide section 43*b*, and the third guide section 43*c*) so that the movable table 61 is located higher when the movable table 61 is closer to the back side of the finger holding case 30 than when the movable table 61 is closer to the opening 42 of the finger holding case 30 on the front side (the side from which the finger is inserted).

In more detail, in a state where the projection 61*a* is guided by the first guide section 43*a* in the finger insertion direction, the movable table 61 is situated lowest in the first finger insertion section 23, and there is a clearance between the nail 11 placed on the nail placement surface 61*d* and the upper wall 37.

In a state where the projection 61*a* is guided by the second guide section 43*b*, the movable table 61 is higher than in a state where the projection 61*a* is guided by the first guide section 43*a*. Moreover, the movable table 61 is higher when it is closer to the back, due to the inclination of the second guide section 43*b*. In this state, too, a clearance is secured between the nail 11 placed on the nail placement surface 61*d* and the upper wall 37. This clearance gradually decreases as the movable table 61 moves backward.

Figure 6:
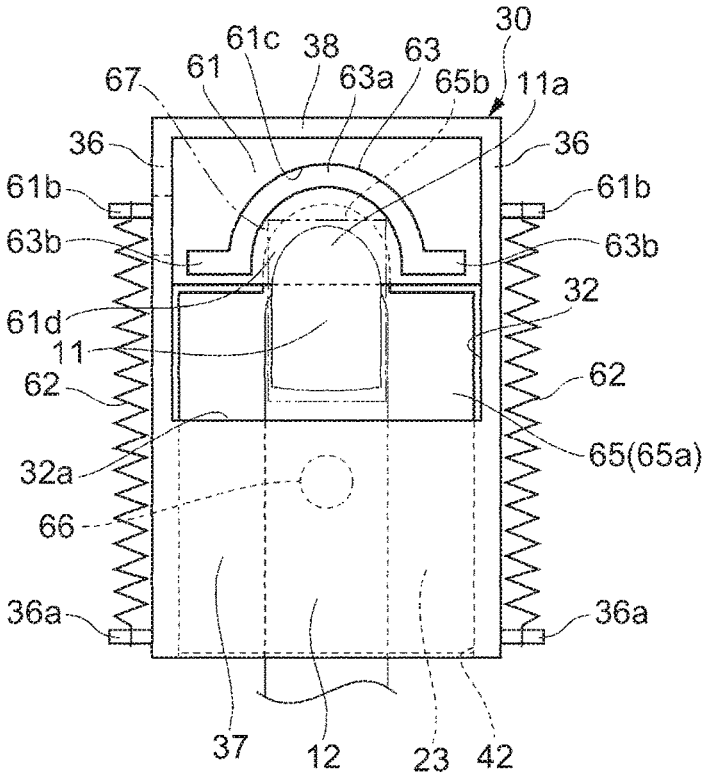
FIG. 6 is a plan view of the finger holding case and its internal structure in a state where the movable table has been moved backward in the finger insertion direction according to the embodiment.

When the projection 61*a* is guided by the third guide section 43*c*, the movable table 61 is higher than when the projection 61*a* is guided by the second guide section 43*b*. Here, the nail 11 placed on the nail placement surface 61*d* is located within the opening 32 in a planar view (see FIG. 6), and is lower than the opening 32.

When the projection 61*a* is fitted into the lock section 43*d* of the third guide section 43*c* from below, the movable table 61 is highest in the first finger insertion section 23. Here, the nail 11 placed on the nail placement surface 61*d* is at the same height as the opening 32 and the upper wall 37 or slightly lower than the opening 32. The operation of the movable table 61 which changes in height in this way will be described in more detail later.

The extension coil spring 62 has one end hooked by the case-side hook 36*a* and the other end hooked by the table-side hook 61*b*, in a state where the movable table 61 and the vertical guide member 63 are incorporated in the finger holding case 30. Thus, the movable table 61 is constantly biased toward the opening 42 of the finger holding case 30 on the front side.

The expansion and contraction member 65 is a hollow cushion, with a fluid supply and discharge section 66 being provided at its bottom. The expansion and contraction member 65 includes: a body section 65*a*; and an extension section 65*b* (see FIG. 6) that extends from the back end of the body section 65*a* underneath the movable table 61 in a state where the movable table 61 has been moved to the backmost part of the finger holding case 30. The extension section 65*b* (see FIG. 6) is, for example, substantially semicircular in a planar view so as to be along the arc-shaped plate section 63*a*.

The expansion and contraction member 65 is configured to expand when a fluid is supplied through the fluid supply and discharge section 66, and contract when the fluid is discharged through the fluid supply and discharge section 66. The fluid is selectable from various gases and liquids. For example, air is suitable as the fluid.

Figure 7:
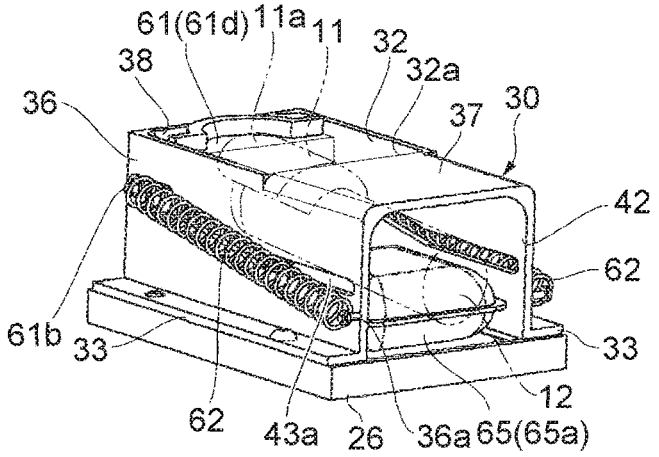
FIG. 7 is a perspective view of the finger holding case and its internal structure in a state where the movable table has been moved backward in the finger insertion direction according to the embodiment, with a finger being indicated by imaginary lines.

As illustrated in FIG. 7, when the expansion and contraction member 65 expands as a result of being supplied with the fluid in a state where the movable table 61 has been moved to the backmost part of the finger holding case 30, the expansion and contraction member 65 pushes the finger 12 inserted in the first finger insertion section 23 and the movable table 61 upward, and raises the finger 12 and the movable table 61 by the body section 65*a* and the extension section 65*b* and presses the inserted finger 12 against the inner surface of the upper wall 37 (the upper surface of the finger insertion section), thus suppressing the movement of the finger 12.

Figure 8:
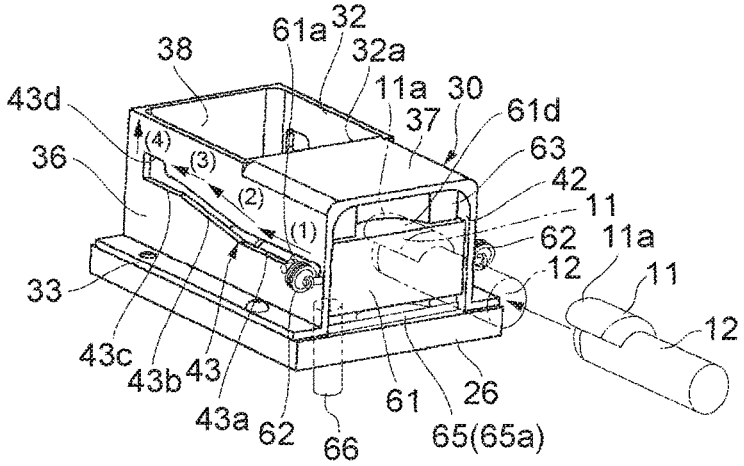
FIG. 8 is a diagram for describing the operation of the movable table and nail according to the embodiment.
Figure 9:
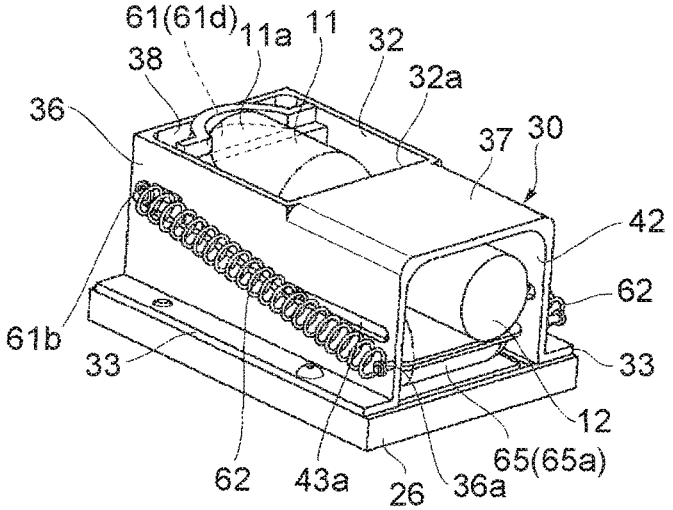
FIG. 9 is a perspective view of the finger holding case and its internal structure in a state where the movable table has been moved backward in the finger insertion direction according to the embodiment, with a finger being indicated by solid lines.

The following describes the operation of each part such as the movable table 61 in the finger holding case 30 in detail with reference to FIGS. 8 and 9, while explaining the positional relationship between the nail 11 and the upper wall 37 or the opening 32.

First, in FIG. 8, the movable table 61 is in a standby state of being situated near the opening 42 of the first finger insertion section 23 on the front side (the side from which the finger is inserted), with the projection 61*a* of the movable table 61 being pressed against the front end of the first guide section 43*a* (the first position) by the biasing force of the extension coil spring 62. When, in this standby state, the user places the distal edge 11*a* of the nail 11 to be drawn on the nail placement surface 61*d* while visually checking it and pushes the movable table 61 with the tip of the finger 12 against the biasing force of the extension coil spring 62, the movable table 61 moves horizontally toward the back of the first finger insertion section 23 while its projection 61*a* is being guided by the first guide section 43*a*, as indicated by arrow (1) in FIG. 8. Here, the nail 11 moves together with the movable table 61, with a clearance being kept between the nail 11 and the upper wall 37.

When the movable table 61 is further pushed backward with the tip of the finger 12 against the biasing force of the extension coil spring 62, the projection 61*a* moves to the inclined second guide section 43*b*. In the process where the projection 61*a* moves backward through the inclined second guide section 43*b*, the movable table 61 moves obliquely upward along the inclination of the second guide section 43*b* while the vertical guide member 63 is guiding the upward movement of the movable table 61 until the projection 61*a* reaches the third guide section 43*c*, as indicated by arrow (2) in FIG. 8. The inclination angle of the second guide section 43*b*, the height of the nail placement surface 61*d*, the height of the upper wall 37, etc. have been set so that the nail 11 does not touch the upper wall 37 while the projection 61*a* moves from the front end of the second guide section 43*b* to the front end of the third guide section 43*c*.

When the movable table 61 is further pushed backward with the tip of the finger 12 against the biasing force of the extension coil spring 62, the projection 61*a* of the movable table 61 moves to the third guide section 43*c*, and the movable table 61 moves horizontally while being guided by the third guide section 43*c* until it reaches the back end of the third guide section 43*c* (the second position (designated as P2 in FIG. 3)), as indicated by arrow (3) in FIG. 8.

Following this, when the fluid is supplied to the expansion and contraction member 65 through the fluid supply and discharge section 66 and the expansion and contraction member 65 expands, the finger 12 and the movable table 61 move upward, and the projection 61*a* is fitted into the lock section 43*d* from below, as indicated by arrow (4) in FIG. 8. Here, the fluid may be automatically supplied to the expansion and contraction member 65 upon detecting, by a sensor or the like, that the movable table 61 has reached the back end of the third guide section 43*c*, or the fluid may be supplied to the expansion and contraction member 65 according to a user operation once the movable table 61 has moved to the second position.

Thus, the movable table 61 is locked at the backmost part of the first finger insertion section 23 (the third position) and set in position, as illustrated in FIG. 9. As a result, the nail 11 is positioned in the drawing area (e.g. a rectangular drawing area 67 in FIG. 6) set in the opening 32 in a planar view, and the finger 12 is pressed against the upper wall 37 and its movement is suppressed.

In a state where the expansion and contraction member 65 expands and the projection 61*a* is locked in the lock section 43*d*, the nail 11 is positioned at the same height as the opening 32 and the upper wall 37 or positioned slightly lower than the opening 32 and the upper wall 37. In such a state where the movement of the finger 12 is suppressed and the height of the nail 11 is set, a nail design is drawn on the nail 11 by the pen plotter section 13 and the inkjet section 15 through the opening 32. Here, since the projection 61*a* is locked in the lock section 43*d*, the movable table 61 can be kept from returning to the front side due to the biasing force of the extension coil spring 62, even though the user is not constantly pushing the movable table 61 with the finger 12 during the drawing of the nail design on the nail 11.

After the drawing on the nail 11 is completed and the fluid is discharged from the expansion and contraction member 65 to contract the expansion and contraction member 65, the movable table 61 lowers under its own weight, as a result of which the projection 61*a* comes out of the lock section 43*d* downward. Once the projection 61*a* has come out of the lock section 43*d* downward, the projection 61*a* moves to the front end of the first guide section 43*a* while being guided by the third guide section 43*c*, the second guide section 43*b*, and the first guide section 43*a* in sequence by the biasing force of the extension coil spring 62, and stops at the front end of the first guide section 43*a*. Thus, the movable table 61 and the nail 11 return to the opening 42 side of the first finger insertion section 23 (the side from which the finger is inserted). In such a process where the movable table 61 and the nail 11 return to the opening 42 side, the projection 61*a* is guided by the inclined second guide section 43*b*, so that the nail 11 moves or passes under the upper wall 37 in a state where a clearance is kept between the nail 11 and the upper wall 37.

(Functions and Effects of Embodiment)

The embodiment described above has the following advantageous effects.

According to the embodiment, the user can easily place the distal edge 11*a* of the nail 11 on the nail placement surface 61*d* of the movable table 61 while visually checking it, near the insertion opening 23*a* (see FIG. 1). Moreover, by moving the movable table 61, on which the nail 11 has been placed, backward along the finger insertion direction guide section 43, the nail 11 can be reliably moved to the drawing area 67 and accurately positioned in the drawing area 67. In a state of having been positioned in the finger insertion direction, the nail 11 can also be accurately positioned in the height direction.

The foregoing embodiment describes the operation in which the user places the distal edge of the nail on the nail placement surface and pushes the movable table with the tip of the finger, but the present invention is not limited to such. Even in the case where the user's nail is short and he or she cannot place the nail on the nail placement surface, the user can use the drawing apparatus according to the present invention by pushing the movable table with the tip of the finger while visually checking the tip of the finger. The aforementioned advantageous effect of reliably moving the nail to the drawing area and accurately positioning the nail in the drawing area can thus be achieved.

Furthermore, after a nail design is drawn on the nail 11, the finger 12 can be pulled with the nail 11 being placed on the movable table 61, while keeping the part of the nail 11 on which the nail design has been drawn from touching the upper wall 37. This prevents damage to the drawn part of the nail 11. In addition, when the drawing apparatus 10 is not in use, the movable table 61 blocks the opening 42 of the finger holding case 30, and so prevents trash, dust, and the like from entering the first finger insertion section 23 from the insertion opening 23*a*.

While some embodiments of the present invention have been described above, the scope of the present invention is not limited to these embodiments, but includes the scope of the invention set forth in the claims and its equivalent scope.

What is claimed is:

1. A drawing apparatus comprising:

a drawing section that performs drawing on at least one nail of at least one finger or toe;

an insertion section in which the at least one finger or toe is inserted via an insertion opening;

a movable section that is provided in the insertion section, and which is biased toward a first position near the insertion opening, and moves from the first position to a second position by pushing of the movable section, against the bias, by the at least one finger or toe inserted in the insertion opening; and an expansion and contraction member that is located at least at a lower side of the insertion section, the expansion and contraction member exerting a pushing force so that the inserted at least one finger or toe and the movable section move upwardly when the expansion and contraction member is expanded, and releasing the pushing force when the expansion and contraction member is contracted, wherein the expansion and contraction member raises the movable section from the second position to a third position when the expansion and contraction member is expanded, and presses the inserted at least one finger or toe against an upper surface of the insertion section, to suppress movement of the at least one finger or toe; and the drawing section performs drawing on the at least one nail of the finger or toe in the third position.

2. The drawing apparatus according to claim 1, wherein the at least one nail of the at least one finger or toe is placed on an upper surface of the movable section.

3. The drawing apparatus according to claim 1, comprising a vertical guide member that is movable together with the movable section, and guides vertical movement of the movable section.

4. The drawing apparatus according to claim 1, comprising a guide section that, when the movable section moves from the first position to the second position, guides the movement of the movable section, wherein the guide section guides the movable section so that the movable section is located higher in the second position than in the first position.

5. The drawing apparatus according to claim 4, wherein the movable section includes a projection that is fitted into the guide section from inside, and wherein when the expansion and contraction member is expanded, the movable section is moved from the second position to a third position, and the projection is moved to a lock section formed in the guide section.

6. The drawing apparatus according to claim 1, wherein the movable section blocks at least part of the insertion opening, when the movable section is in the first position.

7. A control method of a drawing apparatus that includes: a drawing section that performs drawing on at least one nail of at least one finger or toe; an insertion section in which the at least one finger or toe is inserted via an insertion opening; a movable section that is provided in the insertion section, and which is biased toward a first position near the insertion opening, and moves from the first position to a second position by pushing of the movable section, against the bias, by the at least one finger or toe inserted in the insertion opening; and an expansion and contraction member that is located at least at a lower side of the insertion section, the expansion and contraction member exerting a pushing force so that the inserted at least one finger or toe and the movable section move upwardly when the expansion and contraction member is expanded, and releasing the pushing force when the expansion and contraction member is contracted, the control method comprising:

raising, by expanding the expansion and contraction member when the movable section is in the second position, the movable section to a third position and pressing the inserted at least one finger or toe against an upper surface of the insertion section, to suppress movement of the at least one finger or toe; and performing drawing on the at least one nail of the at least one finger or toe in the third position, by the drawing section.

8. The control method of a drawing apparatus according to claim 7, wherein the at least one nail of the at least one finger or toe is placed on an upper surface of the movable section.

9. The control method of a drawing apparatus according to claim 7, wherein the drawing apparatus includes a vertical guide member that is movable together with the movable section, and guides vertical movement of the movable section.

10. The control method of a drawing apparatus according to claim 7, wherein the drawing apparatus includes a guide section that, when the movable section moves from the first position to the second position, guides the movement of the movable section, and wherein the guide section guides the movable section so that the movable section is located higher in the second position than in the first position.

11. The control method of a drawing apparatus according to claim 10, wherein the movable section includes a projection that is fitted into the guide section from inside, and wherein when the expansion and contraction member is expanded, the movable section is moved from the second position to the third position, and the projection is moved to a lock section formed in the guide section.

* * * * *